US009833028B2

(12) United States Patent
Jang et al.

(10) Patent No.: US 9,833,028 B2
(45) Date of Patent: Dec. 5, 2017

(54) SPEED EYELASH EXTENDER

(71) Applicant: ISISWIG CO., LTD., Seoul (KR)

(72) Inventors: Mi Hee Jang, Seoul (KR); Deuk Jung Gang, Seoul (KR)

(73) Assignee: ISISWIG CO., LTD., Seoul (KR)

( * ) Notice: Subject to any disclaimer, the term of this patent is extended or adjusted under 35 U.S.C. 154(b) by 95 days.

(21) Appl. No.: 14/785,121

(22) PCT Filed: Apr. 26, 2014

(86) PCT No.: PCT/KR2014/003697
§ 371 (c)(1),
(2) Date: Oct. 16, 2015

(87) PCT Pub. No.: WO2014/175709
PCT Pub. Date: Oct. 30, 2014

(65) Prior Publication Data

US 2016/0058087 A1 Mar. 3, 2016

(30) Foreign Application Priority Data

Apr. 26, 2013 (KR) ..... 10-2013-0046887

(51) Int. Cl.
*A45D 2/48* (2006.01)
*A41G 5/02* (2006.01)

(52) U.S. Cl.
CPC ..... *A41G 5/02* (2013.01); *A45D 2/48* (2013.01)

(58) Field of Classification Search
CPC ..... A45D 2/48; A41G 5/02
See application file for complete search history.

(56) References Cited

U.S. PATENT DOCUMENTS 3,478,754 A * 11/1969 Martin, Jr. ..... A41G 5/02 132/216
2002/0189628 A1* 12/2002 Iosilevich ..... A45D 2/48 132/217
2004/0149303 A1 8/2004 Kobayashi

FOREIGN PATENT DOCUMENTS

| | | |
|---|---|---|
| KR | 2003388390000 | 1/2004 |
| KR | 2003699370000 | 12/2004 |
| KR | 2003730930000 | 1/2005 |
| KR | 1007922290000 | 1/2008 |

* cited by examiner

*Primary Examiner* — Rachel Steitz
(74) *Attorney, Agent, or Firm* — IPLA P.A.; James E. Bame

(57) ABSTRACT

A speed eyelash extender comprising: a pad detaching and attaching part attached to or detached from a first finishing projection and a first seating pad at one side of a first supporting part and attached to or detached from a second finishing projection and a second seating pad at one side of a second supporting part, such that the first seating pad and the second seating pad are attached to or detached from the first supporting part and the second supporting part. Further, the speed eyelash extender according to the present invention further comprises: a first hook formed in the first finishing step at the other side of the first supporting part, a second hook formed in the second finishing step at the other side of the second supporting part, and a detaching and attaching hook attached to and detached from the first hook or the second hook and connected to a connection string.

4 Claims, 2 Drawing Sheets

[Fig. 1]
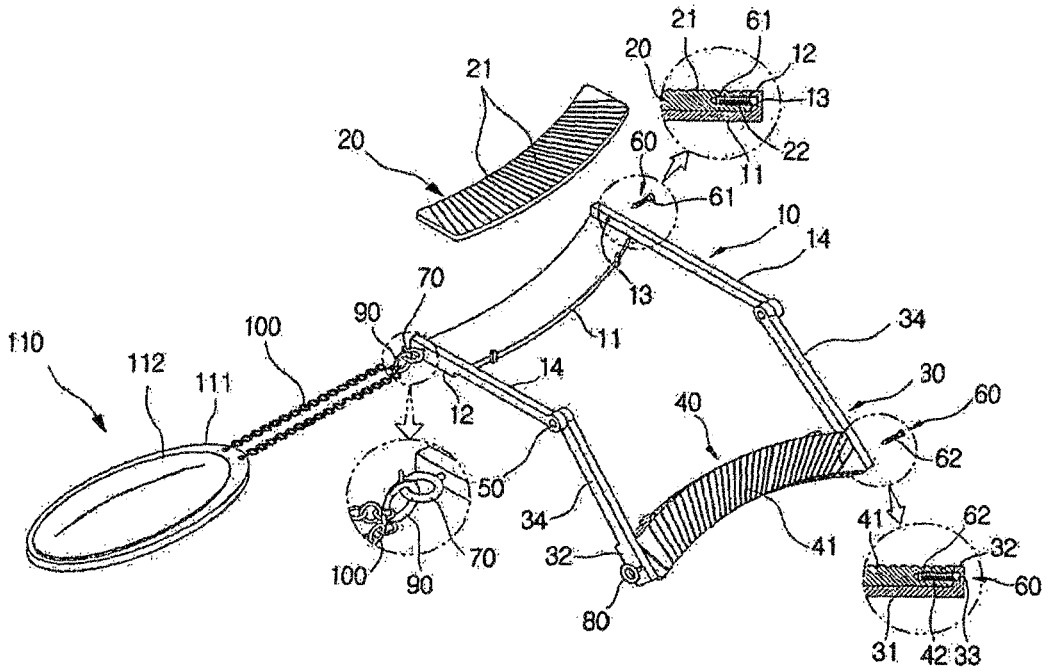
[Fig. 2]
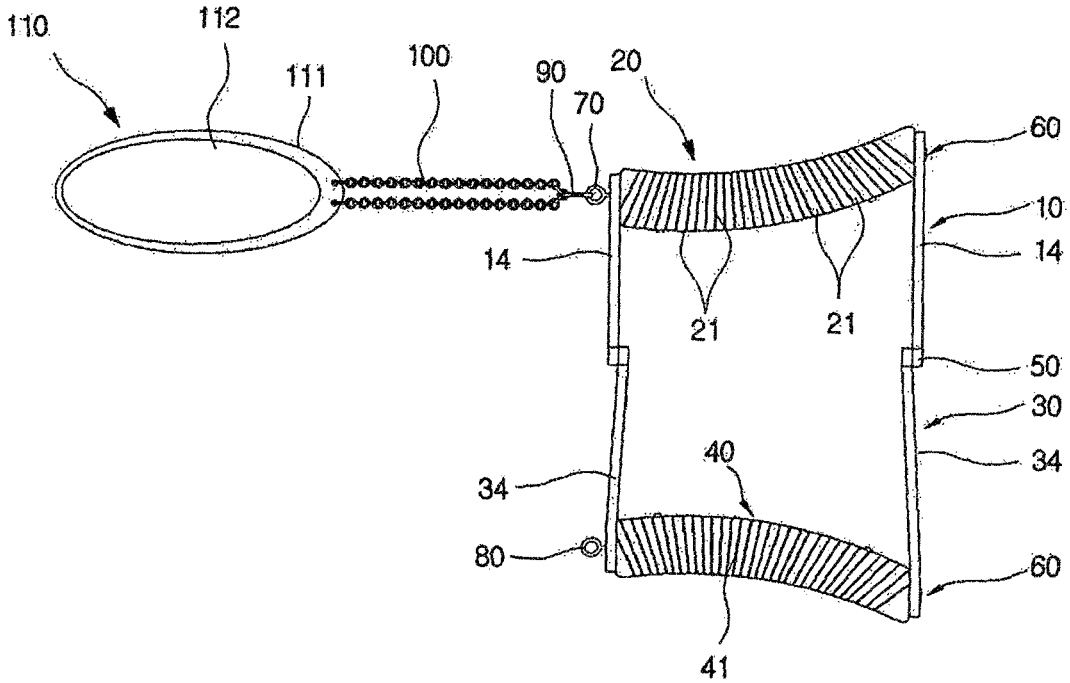

[Fig. 3]
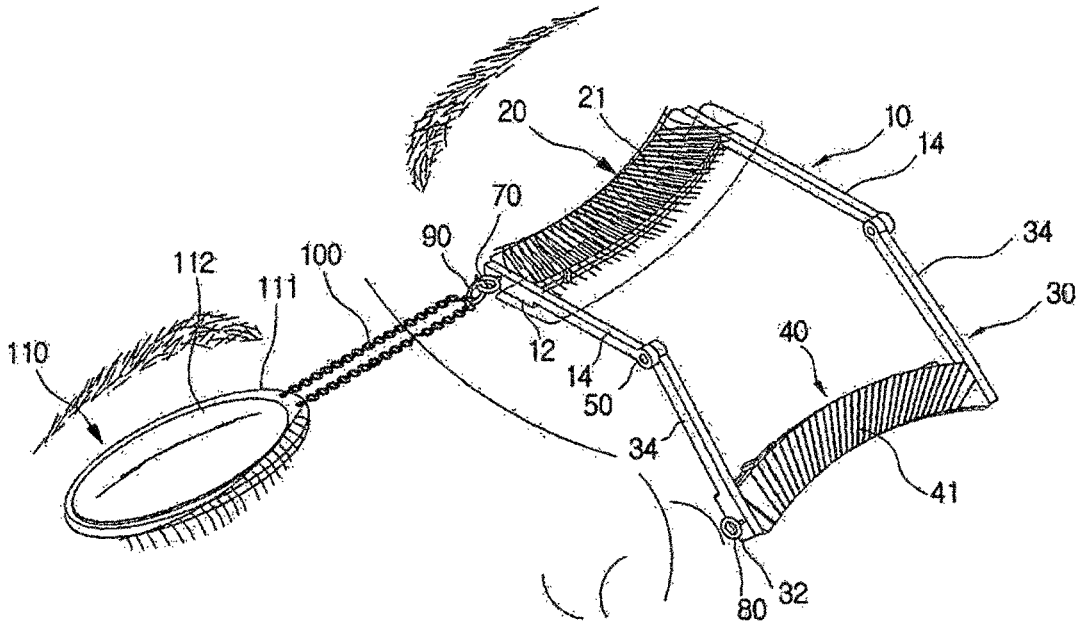
[Fig. 4]
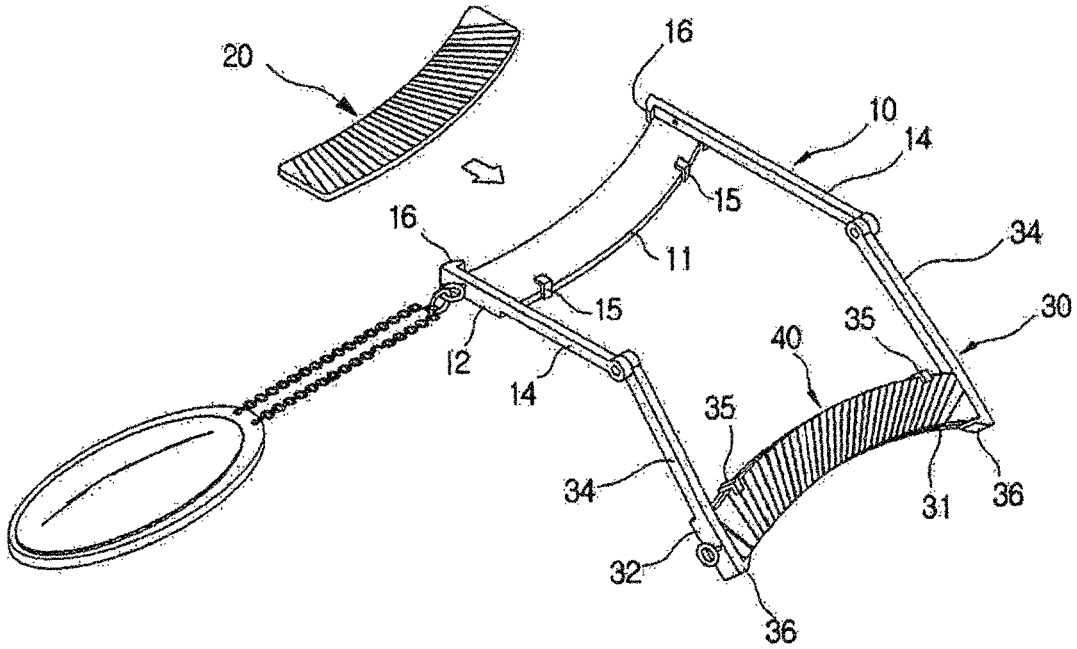

SPEED EYELASH EXTENDER

BACKGROUND

The present invention relates to a speed eyelash extender, and more particularly, to a speed eyelash extender that is configured to have a first seating pad and a second seating pad rigidly coupled to a first supporting part and a second supporting part, to extend left eye eyelashes and right eye eyelashes with one eyelash extender, to improve the assemblability of the first seating pad and the second seating pad to the first supporting part and the second supporting part, and to maintain the top surfaces of the first seating pad and the second seating pad in a clean state.

BACKGROUND ART

Generally, false eyelashes are a kind of cosmetic instruments used to make eyelashes look longer and artificially applied to a user's real eyelashes by means of a tape or adhesive.

According to conventional eyelash applying ways, false eyelashes made of synthetic hair are applied to a user's eyes along her eye shapes through an adhesive or tape, and the rest of false eyelashes after applied are appropriately cut by a tool like scissors.

The adhesive is formed on the whole structure of the false eyelashes, thus undesirably failing to naturally express the user's eye line, causing the eyelashes to be well separated from the user's eye rim, and undesirably allowing the adhesive to enter the user's eyelid.

If the false eyelashes have an adhesive taking a shape of a tape formed on a connection part thereof, the adhesive is applied to the whole eye rim, and at this time, the whole state of the false eyelashes is not natural due to the tension of the adhesive applied to the connection part.

If a thread adhesive made by coating an adhesive onto a thread is applied to the false eyelashes, further, it may be well separated from the connection part of the false eyelashes, thus undesirably failing to use the false eyelashes for long hours.

So as to remove the above-mentioned problems, there is provided Korean Utility Model Registration No. 20-0338839 suggesting eyelashes.

The conventional eyelashes are configured to have a plurality of hairs arranged curvedly and an attaching part formed by collecting one side end part of the plurality of hairs, without any knotting, to which an adhesive is applied, so that the eyelashes are applied to an eye rim.

According to the conventional eyelashes, the eyelashes having the plurality of hairs are applied to the eye rim by using a tool like tweezers according to a user's desired shapes in the state where the adhesive is sufficiently applied to the eye rim.

In the conventional practice, by the way, the eyelashes having the plurality of hairs are one by one applied to appropriate positions of the eye rim through an eyelash extension technician's hands, while the adhesive is being applied to the eye rim, so that a lot of time is needed, a high skilled manual operation is required, and a labor cost is high.

So as to remove such problems, there is provided Korean Patent Registration No. 10-0536633 (entitled 'speed eyelash extension device and method') issued to the same applicant as the invention.

The speed eyelash extension device includes: a bonding unit having a plurality of fine bonding grooves on the top of a bonding body formed in a shape of eyelashes in such a manner as to allow real eyelashes, extended false eyelashes and hair to be insertedly bonded thereto; a compressing unit having a plurality of compression protrusions inserted into the fine bonding grooves on the underside of a compression body so as to compress the fine bonding grooves of the bonding unit into which the real eyelashes, extended false eyelashes and hair are inserted thereagainst; and an adhesive applied to the real eyelashes, extended false eyelashes and hair inserted into the bonding unit and having a bonding force applied to bond the real eyelashes, extended false eyelashes and hair to the fine bonding grooves through the compression of the compressing unit.

According to the conventional speed eyelash extension device, by the way, the eyelashes grow at different intervals according to human beings, thus making it very hard to insert the eyelashes into the bonding grooves of the bonding unit, and further, the eyelashes are escaped from the bonding grooves in the insertion process, thus making the extension hard.

Further, there is no means for supporting the bonding unit and the compressing unit, so that the bonding unit and the compressing unit are fixed to an eyelash extension technician's hands, thus undesirably changing an initial position of the bonding unit during the extension work to make the extension work hard.

So as to remove such problems, accordingly, there is provided Korean Patent Registration No. 10-0792229 (entitled 'speed eyelash extender and eyelash extension method using the same') issued to the same applicant as the invention.

The speed eyelash extender includes: a seating unit formed curvedly in the shape of eyelashes and having a plurality of separated grooves adapted to seat extended false eyelashes and real eyelashes thereon; a coating unit formed on the opposite side to the seating unit; and a supporting unit adapted to hinge-couple the seating unit and the coating unit to support the seating unit and the coating unit thereagainst, whereby the speed eyelash extender is applied to left eye eyelashes or right eye eyelashes.

When the eyelashes are separated individually on the seating surface of the seating unit through a separating unit, the conventional speed eyelash extender separates the eyelashes, while preventing the eyelashes from being collected or united together, and at the same time, puts the eyelashes on the seating surface, thus making the eyelashes simply handled, making the extension work easy, and making the extension time shortened.

By the way, the conventional speed eyelash extender is used only for the left eye eyelashes or the right eye eyelashes, but is not compatibly used for both eyes eyelashes. If the eyelash extender is used for both eyes eyelashes, accordingly, a pair of eyelash extenders is needed, thus increasing the purchase cost of the eyelash extender.

Furthermore, the conventional speed eyelash extender makes use of an adhesive so as to fix the seating unit to the supporting unit, but if the eyelash extender is used for a long period of time, the seating unit is separated from the supporting unit.

PRIOR ART DOCUMENTS (First Patent Document) Korean Utility Model Registration No. 20-0338839

(Second Patent Document) Korean Patent Registration No. 10-0536633

(Third Patent Document) Korean Patent Registration No. 10-0792229 Disclosure

SUMMARY OF THE INVENTION

Accordingly, the present invention has been made in view of the above-mentioned problems occurring in the prior art, and it is an object of the present invention to provide a speed eyelash extender that is configured to have a first seating pad and a second seating pad rigidly coupled to a first supporting part and a second supporting part.

It is another object of the present invention to provide a speed eyelash extender that is configured to allow left eye eyelashes and right eye eyelashes to be extended by using one eyelash extender and to allow eyebrows and hairs to be extended thereby.

It is yet another object of the present invention to provide a speed eyelash extender that is configured to improve the assemblability of a first seating pad and a second seating pad to a first supporting part and a second supporting part.

It is still another object of the present invention to provide a speed eyelash extender that is configured to maintain the top surfaces of a first seating pad and a second seating pad in a clean state.

Technical Solution

To accomplish the above-mentioned objects, according to the present invention, there is provided a speed eyelash extender including: a first supporting part having a first coupling plate, first finishing projections formed on both sides of the first coupling plate, and first connection links fixed to the first finishing projections on one end thereof; a first seating pad seated on the first coupling plate of the first supporting part to allow real eyelashes or false eyelashes to be seated thereon and having a plurality of first seating grooves formed on the top surface thereof; a second supporting part having a second coupling plate, second finishing projections formed on both sides of the second coupling plate, and second connection links fixed to the second finishing projections on one end thereof; a second seating pad seated on the second coupling plate of the second supporting part to allow real eyelashes or false eyelashes to be seated thereon and having a plurality of second seating grooves formed on the top surface thereof; hinge shafts coupled to the end parts of the first connection links of the first supporting part and to the end parts of the second connection links of the second supporting part and serving as the center in the rotation of the first supporting part and the second supporting part; pad detaching and attaching parts detachably attached to the first finishing projection formed on one side of the first supporting part and the first seating pad and detachably attached to the second finishing projection formed on one side of the second supporting part and the second seating pad so as to allow the first seating pad and the second seating pad to be detachably attached to the first supporting part and the second supporting part; a first hook disposed on the first finishing projection formed on the other side of the first supporting part; a second hook disposed on the second finishing projection formed on the other side of the second supporting part; a detaching and attaching hook detachably attached to the first hook or the second hook; a connection string having one side connected to the detaching and attaching hook; and a balance weight having a weight body connected to the other side of the connection string and a decorative part coupled to the weight body.

According to the present invention, desirably, the pad detaching and attaching parts include a first fixing screw and a second fixing screw fastened to the first finishing projection and a first screw hole of the first seating pad and to the second finishing projection and a second screw hole of the second seating pad so as to fix the first seating pad and the second seating pad to the first supporting part and the second supporting part.

According to the present invention, desirably, the first supporting part and the second supporting part include: ㄷ-shaped first stopping projections and second stopping projections formed on the first coupling plate and the second coupling plate so as to fit and grasp the corresponding end parts of the first seating pad and the second seating pad thereto when the first seating pad and the second seating pad are introduced toward the first supporting part and the second supporting part from the outside of the first supporting part and the second supporting part; and first fastening hooks and second fastening hooks formed on the first finishing projections and the second finishing projections so as to allow the rear end both sides of the first seating pad and the second seating pad to be supportedly locked thereon when the introduced front ends of the first seating pad and the second seating pad are supportedly inserted into the first stopping projections and the second stopping projections.

According to the present invention, desirably, the top surfaces of the first seating pad and the second seating pad are coated with an air freshener mixed with functional oil, and 7 to 10 weight % functional oil is mixed to 90 to 93 weight % air freshener, the functional oil consisting of 80 weight % tea tree oil and 20 weight % fennel.

Advantageous Effects

According to the present invention, the pad detaching and attaching parts are provided in such a manner as to be detachably attached to the first finishing projection formed on one side of the first supporting part and the first seating pad and detachably attached to the second finishing projection formed on one side of the second supporting part and the second seating pad, thus allowing the first seating pad and the second seating pad to be detachably attached to the first supporting part and the second supporting part. Accordingly, if the pad detaching and attaching parts are fastened after the first seating pad and the second seating pad are seated on the first supporting part and the second supporting part, one side of the first seating pad and the second seating pad is supported against the first finishing projection of the first supporting part and the second finishing projection of the second supporting part, and the first seating pad and the second seating pad are fixed to the pad detaching and attaching parts, so that the first seating pad and the second seating pad are rigidly coupled to the first supporting part and the second supporting part.

Further, the first hook is provided in such a manner as to be disposed on the first finishing projection formed on the other side of the first supporting part, the second hook is provided in such a manner as to be disposed on the second finishing projection formed on the other side of the second supporting part, and the detaching and attaching hook is provided in such a manner as to be detachably attached to the first hook or the second hook and connected to the connection string. Accordingly, if left eye eyelashes are extended, the detaching and attaching hook is coupled to the first hook, and the balance weight and the connection string are then connected to the first hook, and contrarily, if right eye eyelashes are extended, the detaching and attaching hook is coupled to the second hook, and the balance weight and the connection string are then connected to the second hook. Accordingly, the left eye eyelashes and the right eye eyelashes can be extended with one speed eyelash extender, thus exhibiting excellent compatibility.

Furthermore, the first supporting part and the second supporting part have the first stopping projections and the second stopping projections formed on the first coupling plate and the second coupling plate so as to fit and grasp the corresponding end parts of the first seating pad and the second seating pad thereto when the first seating pad and the second seating pad are introduced toward the first supporting part and the second supporting part from the outside of the first supporting part and the second supporting part. Moreover, the first supporting part and the second supporting part have the first fastening hooks and the second fastening hooks formed on the first finishing projections and the second finishing projections, so as to allow the rear end both sides of the first seating pad and the second seating pad to be supportedly locked thereon when the introduced front ends of the first seating pad and the second seating pad are supportedly inserted into the first stopping projections and the second stopping projections. Accordingly, when the first seating pad and the second seating pad are introduced toward the first supporting part and the second supporting part from the outside of the first supporting part and the second supporting part, they are fitted to the first stopping projections and the second stopping projections and stably grasped thereto, and when the introduced front ends of the first seating pad and the second seating pad are supportedly inserted into the first stopping projections and the second stopping projections, the rear end both sides of the first seating pad and the second seating pad are supportedly locked onto the first fastening hooks and the second fastening hooks. Therefore, the first seating pad and the second seating pad are rapidly and rigidly coupled to the first supporting part and the second supporting part through a simple operation in which the first seating pad and the second seating pad are pushed and fitted to the first stopping projections and the second stopping projections, thus improving the assemblability thereof.

Additionally, the air freshener mixed with the functional oil consisting of 80 weight % tea tree oil and 20 weight % fennel is coated on the top surfaces of the first seating pad and the second seating pad. Accordingly, the functional oil having the sterilizing and insecticidal effects allows the first seating pad and the second seating pad to be cleanly maintained, thus preventing the real eyelashes and the false eyelashes from being contaminated.

BRIEF DESCRIPTION OF DRAWINGS

FIG. 1 is an exploded separate perspective view showing a speed eyelash extender according to a first embodiment of the present invention.

FIG. 2 is a plan view of FIG. 1.

FIG. 3 is a perspective view showing the use state of the speed eyelash extender according to the first embodiment of the present invention.

FIG. 4 is an exploded separate perspective view showing a speed eyelash extender according to a second embodiment of the present invention.

DETAILED DESCRIPTION OF THE INVENTION

Hereinafter, an explanation on a speed eyelash extender according to the present invention will be in detail given with reference to the attached drawing.

FIG. 1 is an exploded separate perspective view showing a speed eyelash extender according to a first embodiment of the present invention, FIG. 2 is a plan view of FIG. 1, and FIG. 3 is a perspective view showing the use state of the speed eyelash extender according to the first embodiment of the present invention.

A speed eyelash extender according to the present invention includes a first supporting part 10, a first seating pad 20, a second supporting part 30, a second seating pad 40, hinge shafts 50, pad detachable attaching parts 60, a first hook 70, a second hook 80, a detachable attaching hook 90, a connection string 100, and a balance weight 110.

The first supporting part 10 has a first coupling plate 11, first finishing projections 12 formed on both sides of the first coupling plate 11 and each having a first through hole 13 formed thereon, and first connection links 14 fixed to the first finishing projections 12 on one end thereof.

The first seating pad 20 is seated on the first coupling plate 11 of the first supporting part 10 to allow real eyelashes or false eyelashes to be seated thereon and has a plurality of first seating grooves 21 formed on the top surface thereof.

The second supporting part 30 has a second coupling plate 31, second finishing projections 32 formed on both sides of the second coupling plate 31 and each having a second through hole 33 formed thereon, and second connection links 34 fixed to the second finishing projections 32 on one end thereof.

The second seating pad 40 is seated on the second coupling plate 31 of the second supporting part 30 to allow real eyelashes or false eyelashes to be seated thereon and has a plurality of second seating grooves 31 formed on the top surface thereof.

The top surfaces of the first seating pad 20 and the second seating pad 40 are coated with an air freshener having functions of sterilization and disinfection, and they can be maintained in a clean state through the action of the sterilization and disinfection.

The air freshener is mixed with functional oil, and at the mixing ratio between the air freshener and the functional oil, 7 to 10 weight % functional oil is mixed to 90 to 93 weight % air freshener. The functional oil consists of 80 weight % tea tree oil and 20 weight % fennel.

In this case, it is desirable that 7 to 10 weight % functional oil is mixed to the air freshener. If the mixture ratio of the functional oil is less than 7 weight %, the effects are weak, and contrarily, if it is more than 10 weight %, the manufacturing cost is very increased, while the functions are being not greatly improved.

The tea tree oil among the functional oil is taken from tree having thorns, leaves and yellow flower heads, and the medical effects of the tea tree oil are known by Australian aborigines. The tea tree oil is used for various dermatologic conditions and skin infections, and during the Second World War, the tea tree oil is used for treating skin wounds since it has functions of sterilization, disinfection and detoxification.

The tea tree oil is effective in acne treatment, sterilization and disinfection, viral disease treatment, respiratory disease treatment, urinary disease treatment, and resistance strength.

The tea tree oil exterminates bacteria including *candida albicans* and *staphylococcus* and is effective in acne treatment, without having any negative effects. Further, the tea tree oil has the sterilization and disinfection effects stronger by 20 times than alcohol. Furthermore, the tea tree oil is very effective in viral diseases like varicella, herpes zoster, herpes, and wart and in mycotic diseases like athlete's foot, *candida* vaginitis and so on.

The tea tree oil has anti-bacteria effects in respiratory diseases and urinary diseases and is thus effective in respiratory disease treatment and urinary disease treatment. Half-body bathing with the tea tree oil enables perspiration to be accelerated to lower a bather's heat, thus releasing an initial cold. Further, the tea tree oil strengthens resistance to effectively fight a disease.

The fennel is a plant included in the same group as aniseed, caraway, coriander and so on and has chemical components like anethol, estragole, camphene and so on, while having excellent anti-bacterial and sterilizing effects.

The functional oil is coated on the top surfaces of the first seating pad 20 and the second seating pad 40 and performs the sterilizing and insecticidal effects to allow the first seating pad 20 and the second seating pad 40 to be cleanly maintained, thus preventing the real eyelashes and the false eyelashes from being contaminated.

The hinge shafts 50 are coupled to the end parts of the first connection links 14 of the first supporting part 10 and to the end parts of the second connection links 34 of the second supporting part 30 and serve as the center in the rotation of the first supporting part 10 and the second supporting part 30.

The pad detaching and attaching parts 60 are detachably attached to the first finishing projection 12 formed on one side of the first supporting part 10 and the first seating pad 20 and detachably attached to the second finishing projection 32 formed on one side of the second supporting part 30 and the second seating pad 40, thus allowing the first seating pad 20 and the second seating pad 40 to be detachably attached to the first supporting part 10 and the second supporting part 30.

The pad detaching and attaching parts 60 include a first fixing screw 61 and a second fixing screw 62 fastened to the first finishing projection 12 and a first screw hole 22 of the first seating pad 20 and to the second finishing projection 32 and a second screw hole 42 of the second seating pad 20 so as to fix the first seating pad 20 and the second seating pad 40 to the first supporting part 10 and the second supporting part 30.

The first hook 70 is disposed on the first finishing projection 12 formed on the other side of the first supporting part 10, and the second hook 80 is disposed on the second finishing projection 32 formed on the other side of the second supporting part 30. The detaching and attaching hook 90 is detachably attached to the first hook 70 or the second hook 80. The connection string 100 has one side connected to the detaching and attaching hook 90. The balance weight 110 includes a weight body 111 connected to the other side of the connection string 100 and a decorative part 112 coupled to the weight body 111.

Under the above-mentioned configuration, the speed eyelash extender according to the present invention has the following characteristics.

Firstly, the pad detaching and attaching parts 60 are provided in such a manner as to be detachably attached to the first finishing projection 12 formed on one side of the first supporting part 10 and the first seating pad 20 and detachably attached to the second finishing projection 32 formed on one side of the second supporting part 30 and the second seating pad 40, thus allowing the first seating pad 20 and the second seating pad 40 to be detachably attached to the first supporting part 10 and the second supporting part 30.

Accordingly, if the pad detaching and attaching parts 60 are fastened after the first seating pad 20 and the second seating pad 40 are seated on the first supporting part 10 and the second supporting part 30, one side of the first seating pad 20 and the second seating pad 40 is supported against the first finishing projection 12 of the first supporting part 10 and the second finishing projection 32 of the second supporting part 30, and the first seating pad 20 and the second seating pad 40 are fixed to the pad detaching and attaching parts 60, so that the first seating pad 20 and the second seating pad 40 are rigidly coupled to the first supporting part 10 and the second supporting part 30.

Secondly, the first hook 70 is provided in such a manner as to be disposed on the first finishing projection 12 formed on the other side of the first supporting part 10, the second hook 80 is provided in such a manner as to be disposed on the second finishing projection 32 formed on the other side of the second supporting part 30, and the detaching and attaching hook 90 is provided in such a manner as to be detachably attached to the first hook 70 or the second hook 80 and connected to the connection string 100.

If left eye eyelashes are extended, accordingly, the detaching and attaching hook 90 is coupled to the first hook 70, and the balance weight 110 and the connection string 100 are then connected to the first hook 70. Contrarily, if right eye eyelashes are extended, the detaching and attaching hook 90 is coupled to the second hook 80, and the balance weight 110 and the connection string 100 are then connected to the second hook 80.

Accordingly, the left eye eyelashes and the right eye eyelashes can be extended with one speed eyelash extender, thus exhibiting excellent compatibility.

Lastly, the air freshener mixed with the functional oil consisting of 80 weight % tea tree oil and 20 weight % fennel is coated on the top surfaces of the first seating pad 20 and the second seating pad 40. Accordingly, the functional oil having the sterilizing and insecticidal effects allows the first seating pad 20 and the second seating pad 40 to be cleanly maintained, thus preventing the real eyelashes and the false eyelashes from being contaminated.

FIG. 4 is an exploded separate perspective view showing a speed eyelash extender according to a second embodiment of the present invention.

A speed eyelash extender according to the second embodiment of the present invention is characterized in that the first seating pad 20 and the second seating pad 40 are detachably attached to the first supporting part 10 and the second supporting part 30 in more simple, rapid and rigid manners.

That is, the first supporting part 10 and the second supporting part 30 have ㄷ-shaped first stopping projections 15 and ㄷ-shaped second stopping projections 35 formed on the first coupling plate 11 and the second coupling plate 31 so as to fit and grasp the corresponding end parts of the first seating pad 20 and the second seating pad 40 thereto when the first seating pad 20 and the second seating pad 40 are introduced toward the first supporting part 10 and the second supporting part 30 from the outside of the first supporting part 10 and the second supporting part 30.

Further, the first supporting part 10 and the second supporting part 30 have first fastening hooks 16 and second fastening hooks 36 formed on the first finishing projections 12 and the second finishing projections 32, so as to allow the rear end both sides of the first seating pad 20 and the second seating pad 40 to be supportedly locked thereon when the introduced front ends of the first seating pad 20 and the second seating pad 40 are supportedly inserted into the first stopping projections 15 and the second stopping projections 35.

Accordingly, when the first seating pad 20 and the second seating pad 40 are introduced toward the first supporting part 10 and the second supporting part 30 from the outside of the first supporting part 10 and the second supporting part 30, they are fitted to the first stopping projections 15 and the second stopping projections 35 and stably grasped thereto, and when the introduced front ends of the first seating pad 20 and the second seating pad 40 are supportedly inserted into the first stopping projections 15 and the second stopping projections 35, the rear end both sides of the first seating pad 20 and the second seating pad 40 are supportedly locked onto the first fastening hooks 16 and the second fastening hooks 36.

Therefore, the first seating pad 20 and the second seating pad 40 are rapidly and rigidly coupled to the first supporting part 10 and the second supporting part 30 through a simple operation in which the first seating pad 20 and the second seating pad 40 are pushed and fitted to the first stopping projections 15 and the second stopping projections 35, thus improving the assemblability thereof.

The invention claimed is:

1. A speed eyelash extender comprising:

a first supporting part having a first coupling plate, first finishing projections formed on both sides of the first coupling plate, and first connection links fixed to the first finishing projections on one end thereof;

a first seating pad seated on the first coupling plate of the first supporting part to allow real eyelashes or false eyelashes to be seated thereon and having a plurality of first seating grooves formed on a top surface thereof;

a second supporting part having a second coupling plate, second finishing projections formed on both sides of the second coupling plate, and second connection links fixed to the second finishing projections on one end thereof;

a second seating pad seated on the second coupling plate of the second supporting part to allow real eyelashes or false eyelashes to be seated thereon and having a plurality of second seating grooves formed on the top surface thereof;

hinge shafts coupled to end parts of the first connection links of the first supporting part and to the end parts of the second connection links of the second supporting part and serving as a center in the rotation of the first supporting part and the second supporting part;

pad detaching and attaching parts detachably attached to the first finishing projection formed on one side of the first supporting part and the first seating pad and detachably attached to the second finishing projection formed on one side of the second supporting part and the second seating pad so as to allow the first seating pad and the second seating pad to be detachably attached to the first supporting part and the second supporting part;

a first hook disposed on the first finishing projection formed on the other side of the first supporting part;

a second hook disposed on the second finishing projection formed on the other side of the second supporting part;

a detaching and attaching hook detachably attached to the first hook or the second hook;

a connection string having one side connected to the detaching and attaching hook; and a balance weight having a weight body connected to the other side of the connection string and a decorative part coupled to the weight body.

2. The speed eyelash extender according to claim 1, wherein the pad detaching and attaching parts comprise a first fixing screw and a second fixing screw fastened to the first finishing projection and a first screw hole of the first seating pad and to the second finishing projection and a second screw hole of the second seating pad so as to fix the first seating pad and the second seating pad to the first supporting part and the second supporting part.

3. The speed eyelash extender according to claim 1, wherein the first supporting part and the second supporting part comprise:

first stopping projections and second stopping projections formed on the first coupling plate and the second coupling plate so as to fit and grasp the corresponding end parts of the first seating pad and the second seating pad thereto when the first seating pad and the second seating pad are introduced toward the first supporting part and the second supporting part from the outside of the first supporting part and the second supporting part; and first fastening hooks and second fastening hooks formed on the first finishing projections and the second finishing projections.

4. The speed eyelash extender according to claim 1, wherein top surfaces of the first seating pad and the second seating pad are coated with an air freshener mixed with functional oil, and 7 to 10 weight % of functional oil is mixed to 90 to 93 weight % of air freshener, the functional oil consisting of 80 weight % of tea tree oil and 20 weight % of fennel.

* * * * *